US010173832B2

(12) United States Patent
Chatelain et al.

(10) Patent No.: US 10,173,832 B2
(45) Date of Patent: Jan. 8, 2019

(54) CONTAINER FOR CONSUMER ARTICLES WITH TAMPER-EVIDENT LID

(71) Applicant: PHILIP MORRIS PRODUCTS S.A., Neuchatel (CH)

(72) Inventors: Lucas Chatelain, Lausanne (CH); David Pitton, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 15/503,537

(22) PCT Filed: Sep. 24, 2015

(86) PCT No.: PCT/EP2015/071981
§ 371 (c)(1),
(2) Date: Feb. 13, 2017

(87) PCT Pub. No.: WO2016/046317
PCT Pub. Date: Mar. 31, 2016

(65) Prior Publication Data

US 2017/0240346 A1 Aug. 24, 2017

(30) Foreign Application Priority Data

Sep. 26, 2014 (EP) ..... 14186679

(51) Int. Cl.
*B65D 85/10* (2006.01)
*B65D 5/54* (2006.01)
(Continued)

(52) U.S. Cl.
CPC ..... *B65D 85/1045* (2013.01); *A24F 15/00* (2013.01); *B65D 5/4266* (2013.01);
(Continued)

(58) Field of Classification Search
CPC ..... A24F 15/00; B65D 5/42; B65D 5/4266; B65D 5/54; B65D 5/542; B65D 65/14;
(Continued)

(56) References Cited

U.S. PATENT DOCUMENTS 3,093,292 A 6/1963 Ahlbor
3,861,583 A 1/1975 Tingley
(Continued)

FOREIGN PATENT DOCUMENTS

CN 1045072 9/1999
CN 2608447 3/2004
(Continued)

OTHER PUBLICATIONS

PCT Search Report and Written Opinion for PCT/EP2015/071981 dated Oct. 15, 2015 (8 pages).
(Continued)

*Primary Examiner* — Bryon Gehman
(74) *Attorney, Agent, or Firm* — Mueting, Raasch & Gebhardt, P.A.

(57) ABSTRACT

A container for consumer articles comprises a box for housing the consumer articles. The box comprises a box front wall, a box back wall and a box top wall. A lid is defined by separation lines in the box front wall and in the box top wall, such that the lid is at least partly separable from the remainder of the box, wherein upon separation from the remainder of the box the lid is pivotable about a hinge line between an open position in which consumer goods can be removed from the container through an access opening of the container and a closed position in which the interior of the container is inaccessible. The container further comprises an inner front panel underlying and attached to at least a portion of the box front wall. The inner front panel is configured to releasably keep the lid in a closed
(Continued)

position when the lid has been at least partly separated from the box.

14 Claims, 3 Drawing Sheets

(51) Int. Cl.
*A24F 15/00* (2006.01)
*B65D 5/42* (2006.01)
*B65D 65/14* (2006.01)

(52) U.S. Cl.
CPC ..... *B65D 5/542* (2013.01); *B65D 65/14* (2013.01); *B65D 85/1036* (2013.01)

(58) Field of Classification Search
CPC . B65D 85/10; B65D 85/1045; B65D 85/1036
USPC ..... 206/264, 268, 273
See application file for complete search history.

(56) References Cited

U.S. PATENT DOCUMENTS

| | | | | |
|---|---|---|---|---|
| 4,062,486 | A | 12/1977 | Goodrich | |
| 5,464,148 | A | 11/1995 | Schoch | |
| 7,290,652 | B2 | 11/2007 | Rath | |
| 7,353,940 | B2 | 4/2008 | Sendo | |
| 7,731,024 | B2 | 6/2010 | Bouno | |
| 7,811,614 | B2 | 10/2010 | Aldridge | |
| 8,893,955 | B2 * | 11/2014 | Clark | B65D 5/427 229/120.09 |
| 9,714,134 | B2 * | 7/2017 | Tacchi | B65D 85/1045 |

FOREIGN PATENT DOCUMENTS

| | | | | |
|---|---|---|---|---|
| CN | 1635973 | | 7/2005 | |
| CN | 1738553 | | 2/2006 | |
| CN | 1968857 | | 5/2007 | |
| CN | 101102945 | | 1/2008 | |
| EP | 0135600 | A1 * | 4/1985 | B65D 5/545 |
| EP | 2765086 | | 7/1988 | |
| EP | 0895940 | | 2/1999 | |
| EP | 1538090 | A1 * | 6/2005 | B65D 5/0254 |
| EP | 1588633 | | 10/2005 | |
| EP | 1783056 | A1 * | 5/2007 | B65D 5/0254 |
| EP | 1837293 | | 9/2007 | |
| EP | 1961675 | | 11/2010 | |
| EP | 1837293 | | 12/2010 | |
| EP | 2281759 | | 2/2011 | |
| EP | 1588633 | | 11/2011 | |
| EP | 2769930 | | 8/2014 | |
| WO | WO 2008006411 | A1 * | 1/2008 | B65D 5/5435 |
| WO | WO 2013/046444 | | 4/2013 | |
| WO | WO 2015173309 | A1 * | 11/2015 | B65D 85/1045 |

OTHER PUBLICATIONS

Extended European Search Report for Application No. 14186679.8 dated Apr. 14, 2015 (6 pages).
Office Action issued in Europe for Application No. 15767496.1 dated May 4, 2018 (6 pages).
Office Action issued in China for Application No. 201580048395.5 dated Jun. 27, 2018 (16 pages). English translation included.

* cited by examiner

CONTAINER FOR CONSUMER ARTICLES WITH TAMPER-EVIDENT LID

This application is a U.S. National Stage Application of International Application No. PCT/EP2015/071981, filed Sep. 24, 2015, which was published in English on Mar. 31, 2016 as International Publication No. WO 2016/046317 A1. International Application No. PCT/EP2015/071981 claims priority to European Application No. 14186679.8 filed Sep. 26, 2014.

The present invention relates to a novel container, which finds particular application as a container for elongate consumer articles, such as smoking articles. For example, containers according to the present invention may be used for housing cigarettes.

It is known to package consumer articles in containers formed from folded laminar blanks. By way of example, elongate smoking articles, such as cigarettes and cigars, are often sold in box shaped containers having a box portion and a lid connected to the box about a hinge line extending across the rear wall of the container. Such containers are typically constructed from one-piece laminar cardboard blanks. In some cases, the container further comprises an inner frame at least partly wrapped around the consumer articles. This may provide further rigidity to the container and protect the consumer articles. In use, the consumer pivots the lid about the hinge line to gain access to the articles held in the box portion.

Containers commonly used for packaging cigarettes and other consumer articles are often wrapped in an outer wrapper. The outer wrapper often includes a tear strip positioned around the container below the lower edge of a front wall of the lid, such that once the tear tape has been removed, the lid is free to be pivoted about the hinge line. Thus, a tear strip may provide tamper evidence in that, once the tear strip is removed, the outer wrapper cannot be reclosed. Alternatively, the outer wrapper or the inner frame may include a seal sticker or ties that the consumer needs to break in order to be able to open the container for the first time. As with a tear strip, a seal tape or ties may provide tamper evidence in that, once broken, they cannot be restored to their original state.

Tamper evidence is a desirable feature as it assures the consumer of the original quality of the product when it left the manufacturer. At the same time, the provision of tamper evidence means, such as the ones described above, is expected to effectively discourage people from tampering with a closed package. However, in order to be able to take advantage of these tamper-evident means, the container needs to be provided with an outer wrapper or an inner frame or with a reclosable label (for example, a self-adhesive label). In particular, the provision of an inner frame of a reclosable label becomes necessary for ensuring a precise and secure reclosing of the container, once the container has been opened for the first time.

It would be desirable to provide an improved tamper-evident container for consumer articles such that precise and secure reclosing of the container is made possible even in the absence of an inner frame and without resorting to a self-adhesive label, while providing that tampering with the container can promptly and easily be revealed. Further, it would be desirable to provide a blank for such improved container that makes its manufacture straightforward and cost-effective.

According to a first aspect of the invention there is provided a container for consumer articles, the container comprising a box for housing the consumer articles. The box comprises a box front wall, a box back wall and a box top wall. A lid is defined by separation lines in the box front wall and in the box top wall, such that the lid is at least partly separable from the remainder of the box. Upon separation from the remainder of the box the lid is pivotable about a hinge line between an open position, in which the consumer goods can be removed from the container through an access opening of the container, and a closed position, in which the interior of the container is inaccessible. The container further comprises an inner front panel underlying at least a portion of the box front wall. Preferably, the inner front panel is attached to at least a portion of the box front wall. The inner front panel comprises reclosing means for releasably keeping the lid in a closed position when the lid has been at least partly separated from the box.

According to a second aspect of the present invention, there is provided a laminar blank for forming a container for consumer articles. The blank comprises a box-defining blank portion for forming a box portion of the container. The box-defining blank portion comprises a back wall panel for forming a box back wall of the container, a front wall panel for forming a box front wall of the container, a top wall panel for forming a top wall of the container and a bottom wall panel for forming a bottom wall of the container. The box-defining portion comprises separation lines extending across the front wall panel and the top wall panel such that a tab is detachable from the box-defining portion to form a lid depending along a hinge line from the back wall panel. The blank further comprises a second front panel comprising means for releasably reclosing a distal end of the lid.

It will be appreciated that any features described with reference to one aspect of the present invention are equally applicable to any other aspect of the invention. Further, advantages described in relation to one aspect of the invention may also apply to another aspect of the invention.

The terms "front", "rear", "upper", "lower", "above", "below", "side", "left", "right", "lateral", "top", "bottom" and other terms used to describe relative positions of the components of containers according to the invention refer to the container in an upright position with an open end of the box portion at the top and the consumer goods accessible from the upper end at the front. The terms "side" and "lateral" are used with reference to side walls of the container when the container is viewed from the front in its upright position.

The term "longitudinal" refers to a direction from bottom to top of the container or vice versa. The term "transverse" refers to a direction substantially perpendicular to the longitudinal direction.

The term "panel" is used throughout this specification to refer to a portion of the blank that is used to form a wall in the assembled container. A panel may depend along one or more fold lines from one or more other panels. The term "fold line" refers to a fold between two adjacent panels. When forming the container, adjacent panels are folded along their common fold line, which may come to define an edge of the container or of a portion thereof. In the assembled container a "wall" may be formed of one or of several overlying panels that are attached to each other, for example by means of an adhesive. Further, a wall may be formed from two or more abutting or overlapping panels.

The term "hinge line" is used throughout this specification to refer to a line common to both the lid portion and the box portion of the container, such that the lid portion is adapted to substantially pivot about said line between a closed position and an open position. The hinge line may extend across the width of the box top wall of the container at any location from the rear edge of the box top wall to the front edge of the box top wall. In some embodiments, the hinge line may substantially coincide with the rear edge of the box top wall. In other embodiments, the hinge line may extend across the width of the box top wall of the container at an intermediate position between the rear edge of the box top wall and the front edge of the box top wall.

The term "separation line" is used in the present specification to refer to a line in a sheet of material, such as paper or cardboard, along which the material has been weakened through removal of some of the material along that line. This facilitates the tearing or breakage of the sheet material along a desired line. A "separation line" in containers according to the present invention may be, for example, provided as a score line, or a line of perforations or slits or cuts. In preferred embodiments, the "separation line" is provided as a line having slits or cuts arranged at predetermined intervals and separated by ties, such that for opening the container for the first time a finite, a relatively small number (2-10) of ties needs to be broken.

The term "line of weakness" is used in the present specification to refer to a line in a sheet of material, such as paper or cardboard, along which the material has been weakened through removal of at least some of the material along that line. This facilitates the separation of a portion of the sheet from the remainder of it along a desired line. A "line of weakness" in containers according to the present invention may be, for example, provided as a score line, or a line of perforations or slits or cuts. In some embodiments, the "line of weakness" is provided as a line having slits or cuts arranged at predetermined intervals and separated by ties, such that for separating a portion of the sheet from the remainder of it a relatively small number (2-10) of ties needs to be broken. In preferred embodiments, the "line of weakness" is a line in a sheet of material, such as paper or cardboard, along which the material has been weakened through removal of substantially all the material along that line. For example, the "line of weakness" may be provided as a pre-cut line, such that a portion of the sheet is already substantially locally separated from the remainder of the sheet material.

The terms "distal" and "proximal" are used to describe the position of components of containers according to the invention relative to their respective points of attachment or origin. In more detail, the term "distal" is used to describe a component of a container according to the invention that is situated away from its point of attachment or origin, whereas the term "proximal" is used to describe a component of a container according to the invention that is situated substantially next to or nearest to its point of attachment. By way of example, a tab depending along a fold line from a panel will extend from a proximal portion, located substantially adjacent the fold line, to a distal end situated opposite the fold line.

In containers according to the invention, lid is practically formed from part of the box front wall and the box top wall. Thus, immediately after manufacturing, the front surface of the container is substantially flat. This is advantageous in that the front of the container comprises no protruding element that may, for example, become lodged when the container is conveyed within a wrapping apparatus or, at a later stage, in a vending machine. Further, because immediately after manufacturing the lid is detachably connected to the box along separation lines, and only after being at least partly separated from the box can the lid pivot between its open and closed positions, it is easy for a consumer to inspect whether the container has been opened before. In practice, integrity of the front panel will indicate to the consumer that the lid has not yet been separated from the box portion and that, therefore, nobody has tampered with the container.

In use, the consumer pivots the lid about the hinge line to gain access to the articles held in the box portion. When the lid is in the open position, an access opening, typically at the upper end of the container, becomes accessible for the consumer. When the lid is in the closed position, the access opening of the container is at least partly occluded by the lid, such that the interior of the container is inaccessible and the consumer cannot remove consumer goods from the container. The container comprises an internal panel underlying the box front wall panel and including reclosing means adapted to engage with the lid, for example with the distal end of the lid. This is advantageous because the container can be securely reclosed once opened (that is, once the "ties" of the separation lines have been broken). Further, even in those embodiments where the reclosing means include a slit or a slot provided in the internal panel, because immediately after manufacture the lid overlaps the slit or slot and is detachably connected to the box front wall panel, the consumer goods are not directly exposed to the outer environment until the container is opened for the first time. Thus, it may not be strictly necessary to provide an outer wrapper around the container with a view to protecting the consumer articles inside the container from any form of exposure to the outer environment.

According to the invention, the lid of the container is defined by separation lines extending across the box front wall and the box top wall, so that the lid is at least partly separable from the remainder of the box. Further, the container comprises an inner front panel underlying the box front wall from which the lid is substantially formed. Thus, once separated from the remainder of the box, the lid is pivotable about a hinge line between an open position and a closed position while the consumer articles are still safely held inside the container at the box front. The reclosing means in the inner front panel are adapted to engage with the lid so that it is possible to reclose the container.

In some embodiments, the box comprises a box bottom wall and the inner front panel depends along a fold line from the bottom wall.

In other embodiments, the box top wall is formed from an inner top panel and an outer top panel. The inner and outer top panels overlap and are attached to one another. The outer top panel depends along a fold line from the box back wall, while the inner front panel depends along a fold line from the inner top panel, the separation lines extending at least across the outer top panel. In some embodiments, the hinge line about which the lid is pivotable may substantially coincide with the fold line about which the box top wall depends from the box back wall.

Preferably, the container is formed from a single laminar blank.

In some embodiments, the container further comprises an inner frame and the inner front panel is defined at least partly by a front panel of the inner frame. This may provide further rigidity to the container and better protect the consumer articles.

Preferably, the re-closing means comprise a slit or slot formed in the inner front panel and adapted to releasably receive and retain a distal end of the lid. As an alternative, the re-closing means may comprise a hook-and-loop fastener. In other embodiments, the re-closing means may be provided as magnetic retaining means. For example, a patch of a magnetic ink may be provided on both a portion of the outer side of the inner front panel and on the inner side of the distal end of the lid. Thus, the container can be re-closed after being opened for the first time and after each and every successive re-opening.

Preferably, the reclosing means comprise a slit or slot formed in the inner front panel and adapted to releasably receive and retain a distal end of the lid. As an alternative, the reclosing means may comprise a hook-and-loop fastener. In other embodiments, the reclosing means may be provided as magnetic retaining means. For example, a patch of a magnetic ink may be provided on both a portion of the outer side of the inner front panel and on the inner side of the distal end of the lid. Thus, the container can be reclosed after being opened for the first time and after each and every successive re-opening.

Preferably, the inner top panel comprises lines of weakness for separating the lid from the remainder of the inner top panel.

In any of the embodiments described above, the container is preferably filled with elongate smoking articles, such as, for example, cigarettes, cigars or cigarillos. It will be appreciated that through appropriate choices of the dimensions, containers according to the invention may be designed for different numbers of conventional size, king size, super-king size, slim or super-slim cigarettes. However, containers in accordance with the present invention can also be used with a variety of consumer goods other than smoking articles.

Containers according to the present invention can conveniently be manufactured by folding laminar blanks made from any suitable materials including, but not limited to, cardboard, paperboard, plastic, metal, or combinations thereof. Preferably, the container is formed from a folded laminar cardboard blank. Preferably, the cardboard has a weight of between about 100 grams per square meter and about 350 grams per square meter. In more detail, containers according to the invention will typically be assembled in the conventional way using standard manufacturing equipment, by folding one or more laminar blanks around the consumer articles and sealing overlying panels of the laminar blanks together in order to retain the container in the assembled shape. This may be achieved using conventional glues or adhesives.

Containers according to the invention may comprise box portions in the shape of a rectangular parallelepiped, with right-angled longitudinal and right-angled transverse edges. Alternatively, the box portion may comprise one or more rounded longitudinal edges, rounded transverse edges, bevelled longitudinal edges or bevelled transverse edges, or combinations thereof. For example, the container according to the invention may comprise, without limitation:

- one or two longitudinal rounded or bevelled edges on the front wall, and/or one or two longitudinal rounded or bevelled edges on the back wall.
- one or two transverse rounded or bevelled edges on the front wall, and/or one or two transverse rounded or bevelled edges on the back wall.
- one longitudinal rounded edge and one longitudinal bevelled edge on the front wall, and/or one transverse rounded edge and one transverse bevelled edge on the back wall.
- one or two transverse rounded or bevelled edges on the front wall and one or two longitudinal rounded or bevelled edges on the front wall.
- two longitudinal rounded or bevelled edges on a first side wall or two transverse rounded or bevelled edges on the second side wall.

Where the container comprises one or more rounded edges and is made from one or more laminar blanks, preferably the blanks comprise three, four, five, six or seven scoring lines or creasing lines to form each rounded edge in the assembled container. The scoring lines or creasing lines may be either on the inside of the container or on the outside of the container. Preferably, the scoring lines or creasing lines are spaced from each other by between about 0.3 mm and 4 mm.

Preferably, the spacing of the creasing lines or scoring lines is a function of the thickness of the laminar blank. Preferably, the spacing between the creasing lines or scoring lines is between about 0.5 and about 4 times larger than the thickness of the laminar blank.

Where the box portion of the container comprises one or more bevelled edge, preferably the bevelled edge has a width of between about 1 mm and about 10 mm, preferably between about 2 and about 6 mm. Alternatively, the container may comprise a double bevel formed by three parallel creasing or scoring lines that are spaced such that two distinct bevels are formed on the edge of the container.

Where the box portion of the container comprises a bevelled edge and is made from one or more laminar blanks, the bevel may be formed by two parallel creasing lines or scoring lines in the laminar blank. The creasing lines or scoring lines may be arranged symmetrically to the edge between a first wall and a second wall. Alternatively, the creasing lines or scoring lines may be arranged asymmetrically to the edge between the first wall and the second wall, such that the bevel reaches further into the first wall of the container than into the second wall of the container.

Through an appropriate choice of the dimensions thereof, containers according to the invention may be designed to hold different total numbers of smoking articles, or different arrangements of smoking articles. For example, through an appropriate choice of the dimensions thereof, containers according to the invention may be designed to hold a total of between ten and twenty smoking articles.

The smoking articles in the container may be arranged in different collations, depending on the total number of smoking articles. For example, the smoking articles may be arranged in a single row of six, seven, eight, nine or ten. Alternatively, the smoking articles may be arranged in two or more rows. The two or more rows may contain the same number of smoking articles. For example, the smoking articles may be arranged in: two rows of five, six, seven, eight, nine or ten; three rows of five or seven; or four rows of four, five or six. Alternatively, the two or more rows may include at least two rows containing different number of smoking articles to each other. For example, the smoking articles may be arranged in: a row of five and a row of six (5-6); a row of six and a row of seven (6-7); a row of seven and a row of eight (7-8); a middle row of five and two outer rows of six (6-5-6); a middle row of five and two outer rows of seven (7-5-7); a middle row of six and two outer rows of five (5-6-5); a middle row of six and two outer rows of seven (7-6-7); a middle row of seven and two outer rows of six (6-7-6); a middle row of nine and two outer rows of eight (8-9-8); or a middle row of six with one outer row of five and one outer row of seven (5-6-7).

Containers according to the present invention may hold smoking articles of the same type or brand, or of different types or brands. In addition, both filterless smoking articles and smoking articles with various filter tips may be contained, as well as smoking articles of differing length (for example, between about 40 mm and about 180 mm), diameter (for example, between about 4 mm and about 9 mm). In addition, the smoking articles may differ in strength of taste, resistance to draw and total particulate matter delivery. Preferably, the dimensions of the container are adapted to the length of the smoking articles, and the collation of the smoking articles. Typically, the outer dimensions of the container are between about 0.5 mm to about 5 mm larger than the dimensions of the group or groups of smoking articles housed inside the container.

Preferably, containers according to the invention have a height of between about 60 mm and about 150 mm, more preferably a height of between about 70 mm and about 125 mm, wherein the height is measured from the top wall to the bottom wall of the container.

Preferably, containers according to the invention have a width of between about 12 mm and about 150 mm, more preferably a width of between about 70 mm and about 125 mm, wherein the width is measured from one side wall to the other side wall of the container.

Preferably, containers according to the invention have a depth of between about 6 mm and about 100 mm, more preferably a depth of between about 12 mm and about 25 mm wherein the depth is measured from the front wall to the back wall of the container (comprising the hinge between box and lid).

Preferably, the ratio of the height of the container to the depth of the container is in between about 0.3 to 1 and about 10 to 1, more preferably between about 2 to 1 and about 8 to 1, most preferably between about 3 to 1 and 5 to 1.

Preferably, the ratio of the width of the container to the depth of the container is between about 0.3 to 1 and about 10 to 1, more preferably between about 2 to 1 and about 8 to 1, most preferably between about 2 to 1 and 3 to 1.

Containers according to the invention may be shrink-wrapped or otherwise over wrapped with a transparent polymeric film of, for example, high or low density polyethylene, polypropylene, oriented polypropylene, polyvinylidene chloride, cellulose film, or combinations thereof in a conventional manner. Where containers according to the invention are over wrapped, the over wrapper may include one or more a tear tapes. In addition, the over wrapper may be printed with images, consumer information or other data. The additional outer wrapper may advantageously protect the surface of the container for example against abrasion during handling.

The exterior surfaces of containers according to the invention may be printed, embossed, debossed or otherwise embellished with manufacturer or brand logos, trade marks, slogans and other consumer information and indicia.

A laminar blank for forming a container for consumer articles according to the invention comprises a box-defining blank portion for forming a box portion of the container. The box-defining blank portion comprises a back wall panel for forming a box back wall of the container, a front wall panel for forming a box front wall of the container, a top wall panel for forming a top wall of the container and a bottom wall panel for forming a bottom wall of the container. The box-defining portion comprises separation lines extending across the front wall panel and the top wall panel such that a tab is detachable from the box-defining portion to form a lid depending along a hinge line from the back wall panel. Further, the blank comprises a second front panel comprising means for releasably retaining a distal end of the lid.

In some embodiments, the second front panel depends along a fold line from the bottom wall panel. In other embodiments, the top wall panel depends along a fold line from the back wall panel and the blank further comprises a reinforcing panel that depends, along a fold line, from the front wall panel. Further, the second front panel depends along a fold line from the reinforcing panel.

Preferably, the retaining means comprise a slit or slot formed in the second front panel and adapted to releasably receive a distal end of the tab.

The invention will be further described, by way of example only, with reference to the accompanying drawings, wherein.

Figure 1:
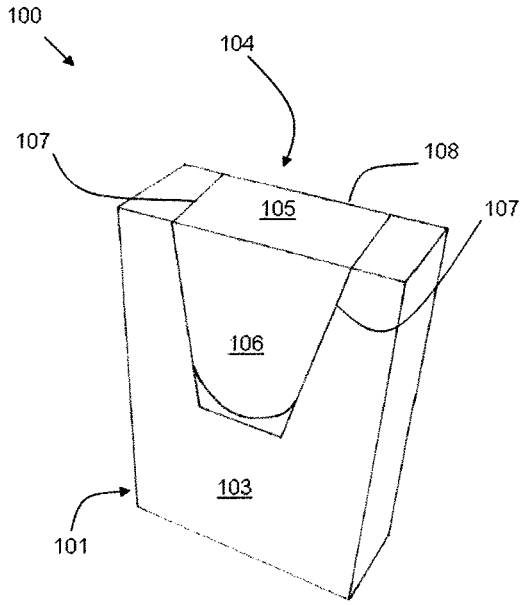
FIG. 1 is a schematic perspective view of a container according to the invention before it is opened for the first time.
Figure 2:
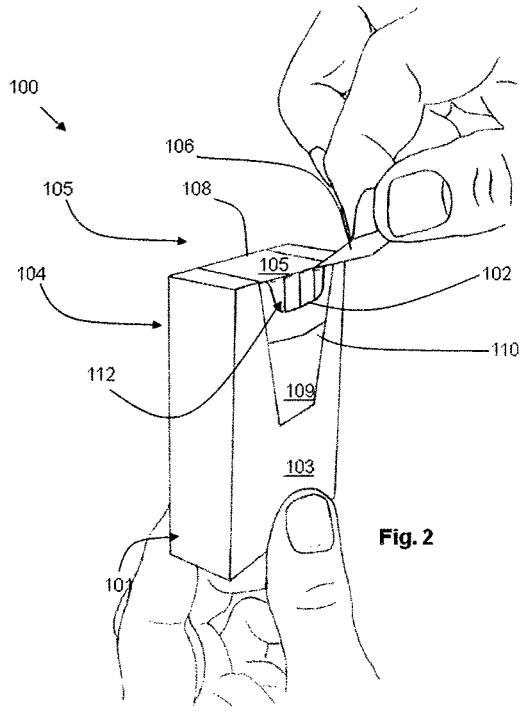
FIG. 2 is another schematic perspective view of the container of FIG. 1 being opened by a consumer.

The container 100 shown in FIGS. 1 to 4 is shaped as a rectangular parallelepiped and comprises a box 101 for housing consumer articles 102. In the embodiment of FIGS. 1 to 4, the consumer articles are elongate smoking articles, such as cigarettes. The box 101 comprises a box front wall 103, a box back wall 104 and a box top wall 105.

A lid 106 is defined by separation lines 107 in the box front wall 103 and in the box top wall 105. Thus, the lid 106 is separable from the remainder of the box on three sides. Upon separation from the remainder of the box, the lid 106 is pivotable about a hinge line 108 between an open position (see, by way of example, FIG. 3) and a closed position (see FIG. 4).

Further, the container 100 further comprises a second front panel 109 underlying and attached to the box front wall 103. The second, inner front panel 109 comprises reclosing means 110 for releasably keeping the lid 106 in the closed position when the lid 106 has been separated from the box 101.

In more detail, the box top wall 105 is formed from an inner top panel 1051 and an outer top panel 1052. The inner and outer top panels 1051, 1052 overlap and are attached to one another. Further, the outer top panel 1052 depends along the hinge line 108 from the box back wall 104, and the inner front panel 109 depends along a fold line from the inner top panel 1051. As shown in FIGS. 1 to 4, the separation lines 107 extend across the outer top panel 1052 and a part of the box front wall 102. The reclosing means 110 comprise a slit formed in the inner front panel 109 and adapted to releasably receive and retain a distal end of the lid 106. In other embodiments (not shown) the slit may be replaced by a slot or by other reclosing means such as a hook-and-loop fastener or magnetic retaining means as mentioned above. Before the container 100 is opened for the first time, the lid 106 extends over the slit (see FIG. 1). In order to open the container for the first time, the consumer detaches the lid 106 off the remainder of the box, for example by holding the distal end of the lid 106 and pulling it away from the box front wall 103. Thus, the ties connecting the lid 106 to the box front wall 103 and the box top wall 105 along the separation lines 107 are broken (see FIG. 2). Thus, it is easy for a consumer to inspect whether the container 100 has been opened before. In practice, integrity of the box front wall 103 will indicate to the consumer that the lid 106 has not yet been separated from the box 101 and that, therefore, nobody has tampered with the container 100.

Figure 3:
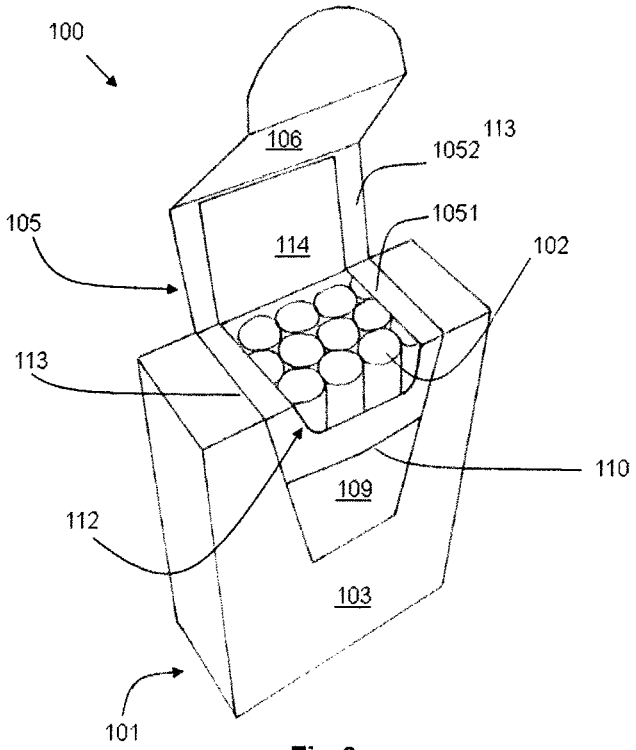
FIG. 3 is another schematic perspective view of the container of FIGS. 1 and 2 with the lid pivoted in an open position.
Figure 4:
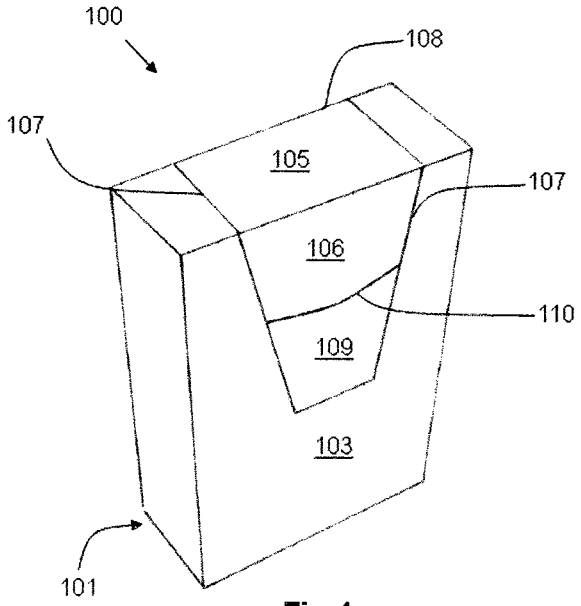
FIG. 4 is yet another schematic perspective view of the container of FIGS. 1 to 3 with the lid pivoted back into its closed position.

The lid 106 can conveniently be pivoted into an open position (see FIG. 3). Further, every time that the container 100 is opened, the lid 106 can be pivoted back into a closed position, wherein it prevents access to the access opening in the upper end of the container 100 and the distal end 106 is received into the slit (see FIG. 4), thus ensuring a secure reclosing of the container 100.

In the embodiment of FIGS. 1 to 4, the inner front panel comprises a cut out 112 adjacent the inner lid top panel 1051, such that the upper access opening of the container 100 is partly defined by the cut out 112. Further, lines of weakness 113 are provided in the inner top panel 1051. Thus, a proximal portion 114 of the inner top panel 1051 is defined that, when the lid 106 is separated from the remainder of the box 101, becomes easily free to pivot about the hinge line 108 with the portion of outer top panel 1052 also forming the lid 106. In particular, in the embodiment of FIGS. 1 to 4, the lines of weakness 113 are pre-cut lines. Accordingly, the proximal portion 114 of the inner top panel 1051 is substantially free to pivot about the hinge line 108 even prior to the first opening of the container 100. Thus, in order to effectively expose the upper access opening of the container 100, the consumer only needs to exert a force sufficient to separate the portion of outer top panel 1052 that forms part of the lid 106 from the remainder of the box, without having to break any ties in the inner top panel 1051. At the same time, because the box top wall 105 is formed by two superimposed panels, the strength of the top portion of the container 100 is improved.

In an alternative embodiment (not shown), the container may comprise an inner frame at least partly wrapped around the consumer articles. This may provide further rigidity to the container and protect the consumer articles. This alternative embodiment of a container according to the invention differs from the container 100 described above in that a front panel of the inner frame defines a second (inner) front panel, whereby the lid may be reclosed and secured to retaining means provided in the front panel of the inner frame.

Figure 5:
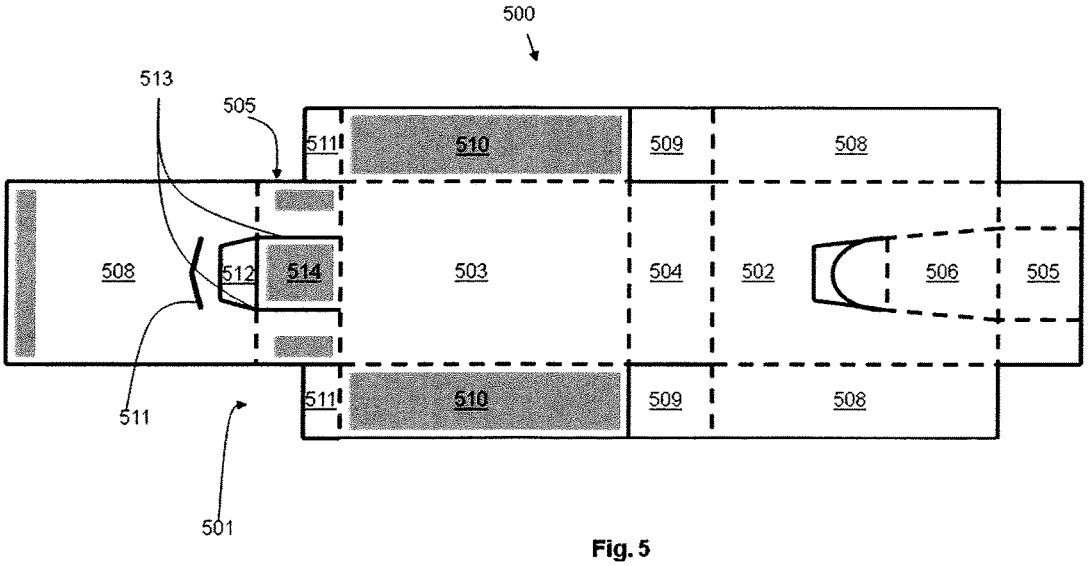
FIG. 5 is a top view of a blank for forming the container of FIGS. 1 to 4.

The container 100 of FIGS. 1 to 4 is formed from the single laminar blank 500 illustrated in FIG. 5. In FIG. 5, solid lines indicate cut lines and dashed lines indicate fold lines. Further, grey areas indicate where, by way of example, a layer of glue may be applied to affix overlapping panels of the blank 500 when forming the container 100, as will be explained in the following.

The blank 500 comprises a box blank portion 501 for forming the box 101 of the container 100. The box blank portion 501 comprises a front wall panel 502, a back wall panel 503 and a bottom wall panel 504. Two side panels 508 extend from the front wall panel 502, two side panels 510 extend from the back wall panel 503 and two box dust flaps 509 extend from bottom wall panel 504. When the box 101 of the container 100 is assembled from the box blank portion 501, the front wall panel 501 forms the front wall 103, the back wall panel 503 forms the back wall 104, the side wall panels 508, 510 overlap to form left and right side walls, and box dust flaps 509 overlap bottom wall panel 504 to form the bottom wall. The side wall panels 508, 510 are substantially the same size and shape as each other. When the container 100 is formed, the side wall panels 508, 510 directly overlie each other with their free edges substantially aligned, such that the inner side wall panel is barely visible. Box dust flaps 509 are smaller than the bottom wall panel 504. When the container 100 is formed, the box dust flaps 509 lie inside bottom wall panel 504. They provide additional structural support for the bottom wall of the container but are not visible from the outside of the container.

The blank 500 further comprises a top wall panel 505 for forming the box top wall 105 of the container 100. The top wall panel 505 depends along a fold line from the front wall panel 502. Separation lines 107 extend across the front wall panel 502 and the top wall panel 505, so that a tab 506 is detachable from the box blank portion 501. Further, the blank 500 comprises a top wall reinforcing panel 507 and a second front panel 508. The top wall reinforcing panel 507 depends along a fold line from the back wall panel 503. The second front panel 508 depends along a fold line from the top wall reinforcing panel 507. The top wall panel 505 and the top wall reinforcing panel 507 have substantially the same shape and size. When the box 101 of the container 100 is assembled from the box blank portion 501, the top wall panel 505 overlaps and is affixed to the top wall reinforcing panel 507 to form the box top wall 105, so that, when it is separated from the front wall panel 502 and the top wall panel 505, the tab 506 depends from the box back wall 503 along a hinge line defined by the fold line along which the top wall reinforcing panel 508 depends from the back wall panel 503.

The second front panel 508 comprises a cut out 512 adjacent the top wall reinforcing panel 507, for partly defining an access opening of the container 100. Further, pre-cut lines 513 are provided in the top wall reinforcing panel 507 to define a central tongue 514. Two box dust flaps 511 extend from side panels 510.

When the box 101 of the container 100 is assembled from the box blank portion 501, the central tongue 514 lies under and is affixed to, for example with glue, the tab 506. Thus, in practice, the central tongue 514 and the tab 506 form the lid 106 of the container 100. When the lid 106 is pivoted from the closed position to the open position, the central tongue 514 pivots out of the plane defined by the remainder of the top wall reinforcing panel 507 and an upper opening of the container 100 is made accessible. The box dust flaps 511 are smaller than the top wall reinforcing panel 507, such that, when the container 100 is formed, the box dust flaps 511 lie on the inside of the top wall reinforcing panel 507 without obstructing the upper opening of the container 100. The box dust flaps 511 provide additional structural support for the box top wall 105 of the container 100 but are not visible from the outside of the container.

The second front panel 508 comprises a slit 515. When the box 101 of the container 100 is assembled from the box blank portion 501, the tab 506 extends over the slit 515. When the lid 106 is detached from the remainder of the box 101 for the first time, the slit 515 is exposed and can receive the distal end of the tab 506, so that the container 101 can easily and securely be reclosed.

In an alternative embodiment (not shown) of a blank according to the present invention, the blank may comprise a second front panel depending along a fold line from the box bottom wall.

The invention claimed is:

1. A container for consumer articles, the container comprising:

a box for housing the consumer articles and comprising a box front wall, a box back wall and a box top wall;

wherein a lid is defined by separation lines in the box front wall and in the box top wall, such that the lid is at least partly separable from the remainder of the box, wherein upon separation from the remainder of the box the lid is pivotable about a hinge line between an open position in which consumer goods can be removed from the container through an access opening of the container and a closed position in which the interior of the container is inaccessible;

wherein the container further comprises an inner front panel underlying and attached to at least a portion of the box front wall, wherein the lid is releasably reclosable to the inner front panel, keeping the lid in the closed position when the lid has been at least partly separated from the box; and wherein the box top wall is formed from an inner top panel and an outer top panel, the inner and outer top panels overlapping and being attached to one another, the outer top panel depending along a fold line from the box back wall, and the inner front panel depending along a fold line from the inner top panel, the separation lines extending at least across the outer top panel.

2. A container according to claim 1, wherein the box comprises a box bottom wall and the inner front panel depends along a fold line from the box bottom wall.

3. A container according to claim 1, wherein the box top wall is formed from an inner top panel and an outer top panel, the inner and outer top panels overlapping and being attached to one another, the outer top panel depending along a fold line from the box back wall, and the inner front panel depending along a fold line from the inner top panel, the separation lines extending at least across the outer top panel.

4. A container according to claim 1, wherein the container is formed from a single laminar blank.

5. A container according to claim 1 further comprising an inner frame, wherein the inner front panel is defined at least partly by a front panel of the inner frame.

6. A container according to claim 1, wherein the inner front panel comprises a slit or slot formed in the inner front panel and wherein the slit or slot is adapted to releasably receive and retain a distal end of the lid.

7. A container according to claim 1, wherein the inner front panel comprises a hook-and-loop fastener.

8. A container according to claim 1, wherein the inner front panel comprises means comprise a magnetic member.

9. A container according to claim 1, wherein the inner front panel comprises a cut out adjacent the first lid top panel, thus at least partly defining the access opening.

10. A container according to claim 1, wherein the inner top panel comprises lines of weakness for separating the lid from the remainder of the inner top panel.

11. A container according to claim 1, containing one or more smoking articles.

12. A laminar blank for forming a container for consumer articles according to claim 1, the blank comprising:

a box-defining blank portion for forming a box portion of the container;

the box-defining blank portion comprising a back wall panel for forming a box back wall of the container, a front wall panel for forming a box front wall of the container, a top wall panel for forming a top wall of the container and a bottom wall panel for forming a bottom wall of the container;

wherein the box-defining portion comprises separation lines extending across the front wall panel and the top wall panel such that a tab is detachable from the box-defining portion to form a lid depending along a hinge line from the back wall panel, and wherein the blank further comprises a second front panel, wherein the distal end of the lid is releasably reclosable to the second front panel.

13. A blank according to claim 12, wherein the second front panel depends along a fold line from the bottom wall panel.

14. A blank according to claim 12, wherein the second front panel comprises a slit or slot formed in the second front panel and wherein the slit or slot is adapted to releasably receive and retain a distal end of the tab.

* * * * *